US009707793B2

(12) United States Patent
Brocker et al.

(10) Patent No.: US 9,707,793 B2
(45) Date of Patent: Jul. 18, 2017

(54) PRINTING SCREEN

(71) Applicant: GALLUS FERD. RUEESCH AG, St. Gallen (CH)

(72) Inventors: Heinz Brocker, Herisau (CH); Hans-Rudolf Frick, Herisau (CH); Matthias Rosenfelder, Grub Sg (CH)

(73) Assignee: Gallus Ferd. Rueesch AG, St. Gallen (CH)

( * ) Notice: Subject to any disclaimer, the term of this patent is extended or adjusted under 35 U.S.C. 154(b) by 0 days.

(21) Appl. No.: 15/241,344

(22) Filed: Aug. 19, 2016

(65) Prior Publication Data

US 2016/0355041 A1 Dec. 8, 2016

Related U.S. Application Data

(63) Continuation of application No. PCT/EP2014/077310, filed on Dec. 11, 2014.

(30) Foreign Application Priority Data

Feb. 20, 2014 (DE) ..... 10 2014 002 291

(51) Int. Cl.

| | |
|---|---|
| ***B41N 1/24*** | (2006.01) |
| ***B41C 1/14*** | (2006.01) |
| ***B41F 15/08*** | (2006.01) |
| ***B41F 15/36*** | (2006.01) |
| ***B41F 15/38*** | (2006.01) |

(52) U.S. Cl.

CPC ..... *B41N 1/248* (2013.01); *B41C 1/145* (2013.01); *B41F 15/0881* (2013.01); *B41F 15/36* (2013.01); *B41F 15/38* (2013.01); *B41N 1/243* (2013.01); *B41N 1/247* (2013.01)

(58) Field of Classification Search

CPC ..... B41N 1/24; B41N 1/243; B41N 1/247; B41N 1/248; B41F 15/0881; B41F 15/36; B41F 15/38; B41C 1/145

See application file for complete search history.

(56) References Cited

U.S. PATENT DOCUMENTS 3,759,800 A * 9/1973 Reinke ..... B41C 1/14 101/127
3,783,779 A * 1/1974 Greenwood ..... C25D 1/10 101/127

(Continued)

FOREIGN PATENT DOCUMENTS

DE 102011016453 A1 1/2013
EP 0182195 A2 5/1986

(Continued)

*Primary Examiner* — Leslie J Evanisko
*Assistant Examiner* — Marissa Ferguson Samreth
(74) *Attorney, Agent, or Firm* — Laurence A. Greenberg; Werner H. Stemer; Ralph E. Locher

(57) ABSTRACT

A printing screen includes a screen-shaped fabric layer with fabric threads being angled relative to one another to form a carrier layer. An imaged stencil layer is connected to the fabric layer and provided with passages. A respective passage forms a continuous channel and has an opening that is smaller on a printing material side of the printing screen than on a squeegee side of the printing screen. Such a printing screen has sufficient stability and advantageously allows the finest lines and dots to be printed. A method for imaging such a printing screen is also provided.

10 Claims, 8 Drawing Sheets

(56) References Cited

U.S. PATENT DOCUMENTS 4,242,401 A * 12/1980 Mitani ..... B41M 1/12 101/127
4,705,608 A 11/1987 Keller et al.
5,359,928 A * 11/1994 Blessington ..... B41C 1/142 101/128.4
5,662,040 A * 9/1997 Mori ..... B41M 1/12 101/116
6,412,407 B1 7/2002 Brocker et al.
6,722,275 B2 * 4/2004 Coleman ..... H05K 3/1225 101/127
7,223,316 B2 * 5/2007 Murase ..... H01L 21/486 101/127
2004/0261636 A1 * 12/2004 Fleck ..... B41M 1/12 101/129
2005/0274267 A1 * 12/2005 Cobbley ..... B41F 15/0818 101/127
2011/0259218 A1 * 10/2011 Becker ..... B41N 1/247 101/127
2012/0174806 A1 * 7/2012 Spoor ..... B41C 1/14 101/123
2013/0032048 A1 * 2/2013 Falcon ..... B41F 15/36 101/128.4
2013/0084676 A1 4/2013 Shinike et al.

FOREIGN PATENT DOCUMENTS

JP 63-008746 * 1/1988 ..... B41N 1/24
JP 03215096 A 9/1991
JP 06-143855 * 5/1994 ..... B41N 1/24
JP 2001-239767 * 9/2001 ..... B41N 1/24
JP 2002326337 A 11/2002
JP 2004-721012 * 3/2003 ..... B41C 1/14
JP 2003-307833 * 10/2003 ..... B41N 1/24
JP 2006-150868 * 6/2006 ..... B41N 1/24
JP 2006-327122 * 12/2006 ..... B41N 1/24
JP 2007-334058 * 12/2007 ..... B41N 1/24
JP 2008-162277 * 7/2008 ..... B41N 1/24
WO 9919146 A1 4/1999

* cited by examiner

PRINTING SCREEN

CROSS-REFERENCE TO RELATED APPLICATION

This is a continuation application, under 35 U.S.C. §120, of copending International Application PCT/EP2014/077310, filed Dec. 11, 2014, which designated the United States; this application also claims the priority, under 35 U.S.C. §119, of German Patent Application DE 10 2014 002 291.9, filed Feb. 20, 2014; the prior applications are herewith incorporated by reference in their entirety.

BACKGROUND OF THE INVENTION

Field of the Invention

The invention relates to a printing screen for a screen printing process including a screen-shaped fabric layer as a carrier structure, in particular including threads of fabric disposed at an angle relative to one another, and an imaged stencil layer connected to the fabric layer and provided with passages, in which a respective passage has a smaller opening on a printing material side of the printing screen than on a squeegee side of the printing screen and forms a continuous channel.

The industrial use of screens and fabrics is known in many fields. Screens used for filtration purposes usually have a square mesh. That mesh shape has also been used in the printing industry. However, when using the available photosensitive layers and the known application methods, an acceptable image resolution can only be achieved by a large number of "supports." That is why the use of fabrics of a high mesh count is becoming increasingly common.

The field of printing electronics requires the use of the thinnest possible screens or of fabrics made of the thinnest possible wire to provide a smooth flow of paste and to allow very sophisticated images to be printed.

The field of coating solar cells, i.e. of metalizing solar cells, requires the application of a large amount of paste and a very accurate and high image resolution, for instance when conductive paths are applied as current fingers, covering as little of the solar cells as possible to ensure a high degree of efficiency of the solar cells.

The screens/types of fabric used for printing electronics are very expensive and delicate to process, making them unsuitable for manufacturing screen printing plates for rotary screen printing. The lack of suitability is also due to the fact that a screen fabric used as a rotary screen may only be tensioned in one direction, namely in the direction of the longitudinal axis of the cylinder, whereas it can be tensioned in two directions in flat screen printing processes.

In rotary screen printing, the ink is transported through the screen due to the hydrodynamic pressure that is created in front of the squeegee face by the rotation of the screen as the squeegee is engaged. For structural reasons, only open or half-open squeegee systems may be used, which means that the dynamic pressure is subject to many influencing factors such as the viscosity, fill level, and rotary speed. Increasing the rotary speed or the amount of ink are easy ways of increasing the hydrodynamic pressure.

Such a rotary screen printing unit is described, for instance, in International Publication WO 99/19146 A1, corresponding to U.S. Pat. No. 6,412,407.

In accordance with the prior art, the basic structures used in screen materials are plain-woven stainless steel fabrics. Their ratio between screen opening, contact area, and fabric thickness has been found to be suitable. The thickness of the structure, i.e. the fabric thickness (initial measure prior to calendering) approximately corresponds to twice the wire thickness. In an additional step, the basic structure is treated in a calendering process to obtain the desired raw fabric thickness. At the same time, a smoother screen is obtained, resulting in less wear to the screen and the squeegee. In a subsequent nickel-plating process the fabric is reinforced to give it a higher degree of mechanical stability and resistance to wear and to enlarge the support points in the region of the intersections.

A method for manufacturing such screen materials is described, for instance, in European Patent Application EP 0 182 195 A2, corresponding to U.S. Pat. No. 4,705,608.

Electro-formed screens are used as an alternative to the woven screen materials. The use of metal fleece, synthetic fabric, perforated plates, metal films, and combinations thereof is also known in the art.

In order to ensure that dots and lines of ink are printed accurately, the presence of line or dot-shaped passages, also referred to as ink channels, leading from the squeegee side of the screen materials to the printing material side of the screen materials needs to be ensured when the screen materials are being imaged. Those ink channels must not be interrupted or obstructed by threads of fabric. Thus in accordance with the prior art, the ink channels have a width that corresponds to a multiple of the diameter of the fabric threads (2 times or 2.5 times the diameter at the minimum). Such a screen material is described in German Patent Application DE 10 2011 016 453 A1.

However, if fine lines (of approximately 10 to 100 micrometers) and dots are to be printed as required for printing electronic structures and solar cells, the ink channels need to be narrow.

In order to nevertheless ensure a flow of ink from the squeegee side to the printing material side of the screen materials, fabrics having a very fine woven structure are used. Such fabrics are frequently woven of threads having a diameter of less than 30 micrometers, allowing a mesh count of 300 (number of openings per inch). Such fine-mesh screen materials are more expensive to manufacture and have a low stability.

Electroformed screens have very fine holes with the known hexagonal, quadrangular, and circular hole geometry.

SUMMARY OF THE INVENTION

It is accordingly an object of the invention to provide a printing screen for a screen printing process and a method for imaging the printing screen, which overcome the hereinafore-mentioned disadvantages of the heretofore-known printing screens and methods of this general type and in which the printing screen has sufficient stability and allows very fine lines and dots to be printed.

With the foregoing and other objects in view there is provided, in accordance with the invention, a printing screen comprising a screen-shaped fabric layer, in particular having a carrier structure of fabric threads disposed at angles relative to one another, in particular at right angles, and an imaged stencil layer. In this context, electroformed screens, for instance made of nickel, and perforated plates or films such as stainless steel films are considered to be screen-shaped fabric layers. The stencil layer and the fabric layer are interconnected, with the fabric layer at least partly embedded in the stencil layer. The stencil layer has passages allowing ink to flow from a squeegee side of the printing screen to a printing material side of the printing screen. In accordance with the invention, a respective passage has a smaller opening, i.e. an opening of a smaller width, on the printing material side of the printing screen than on the squeegee side of the printing screen, thus forming a continuous channel from the squeegee side to the printing material side as an ink passage. In accordance with the invention, the opening of the passage on the squeegee side is greater than a diameter of a potentially coated fabric thread. The opening of the passage on the printing material side at maximum corresponds to the diameter of a potentially coated fabric thread. This allows particularly fine structures to be printed. The opening of the passage on the printing material side may be considerably smaller than the diameter of a potentially coated fabric thread. A respective passage may be line-shaped, i.e. having a certain length, or dot-shaped, to be able to print ink lines or only individual dots. Depending on the image to be printed, the passages may be disposed to be offset in parallel, in the same position as, or at an oblique angle relative to the fabric threads.

A printing screen of this type advantageously allows particularly fine lines and dots to be printed. The small opening of the passage on the printing material side allows particularly fine line widths, whereas the larger opening on the squeegee side ensures a continuous flow of ink, allowing lines and dots to be printed while the amount of ink that is applied, i.e. the thickness of the line, remains constant.

A respective passage that is constructed in this way may also be referred to as an ink channel.

In accordance with an advantageous further development of the printing screen of the invention, a respective passage may have channel walls of different constructions. For instance, oblique and/or stepped and/or convex and/or concave channel walls are considered to be advantageous.

In accordance with a particularly advantageous and thus preferred embodiment, the fabric layer of the printing screen is a woven steel fabric, in particular made of stainless steel. Alternatively, polyester fabrics may be used. In accordance with an advantageous further feature, the fabric layer may have a stabilizing metal coating, in particular a metal coating containing nickel. The fabric layer may be calendered if desired. Even very strong calendering up to a maximum of one times the wire thickness may be advantageous. The stencil layer is advantageously made of a polymer, in particular a photopolymer, i.e. a photosensitive polymer, allowing the screen to be imaged in a particularly easy way.

With the objects of the invention in view, there is also provided a method for imaging a printing screen, which comprises providing at least one screen-shaped fabric layer as a carrier structure and an imageable stencil layer, wherein the stencil layer is provided with passages, also referred to as ink channels, in the imaging process to allow ink to flow from a squeegee side to a printing material side of the printing screen. In accordance with the invention, a respective passage is created to have a smaller opening on the printing material side than on the squeegee side of the printing screen, resulting in the advantages described above.

In accordance with an advantageous further development of the method of the invention, the stencil layer is imaged by using a laser. The laser is controlled in such a way as to penetrate to different depths, i.e. to produce an effect down to different depths below the surface of the stencil layer. The laser imaging involves the two alternatives of curing by polymerization and burning off the photosensitive layer (in a way similar to laser cutting). Alternatively, the stencil layer may be imaged in a conventional exposure process using a number of photographic screens at varying exposure times and intensities. In an alternative method, the stencil layer is imaged using different light spectrums, i.e. light of different wavelengths. For this purpose, the stencil layer may be built up of different emulsion layers of different sensitivity. The stencil layer may also be imaged by using photographic screens of specific construction, for instance having locally varying light permeability.

The invention also relates to a printing screen imaging device suitable for implementing the method described above for creating printing screens as described above.

Combinations of the invention described above and the further developments of the invention described above, namely the channel walls of different constructions, also form advantageous further developments of the invention.

Filtration also requires very fine passages. Thus screens constructed as described above may advantageously be used for polymeric membranes. Their use makes cleaning easier and contributes to less adhesion during back-flushing.

Other features which are considered as characteristic for the invention are set forth in the appended claims.

Although the invention is illustrated and described herein as embodied in a printing screen and a method for imaging the same, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 6:
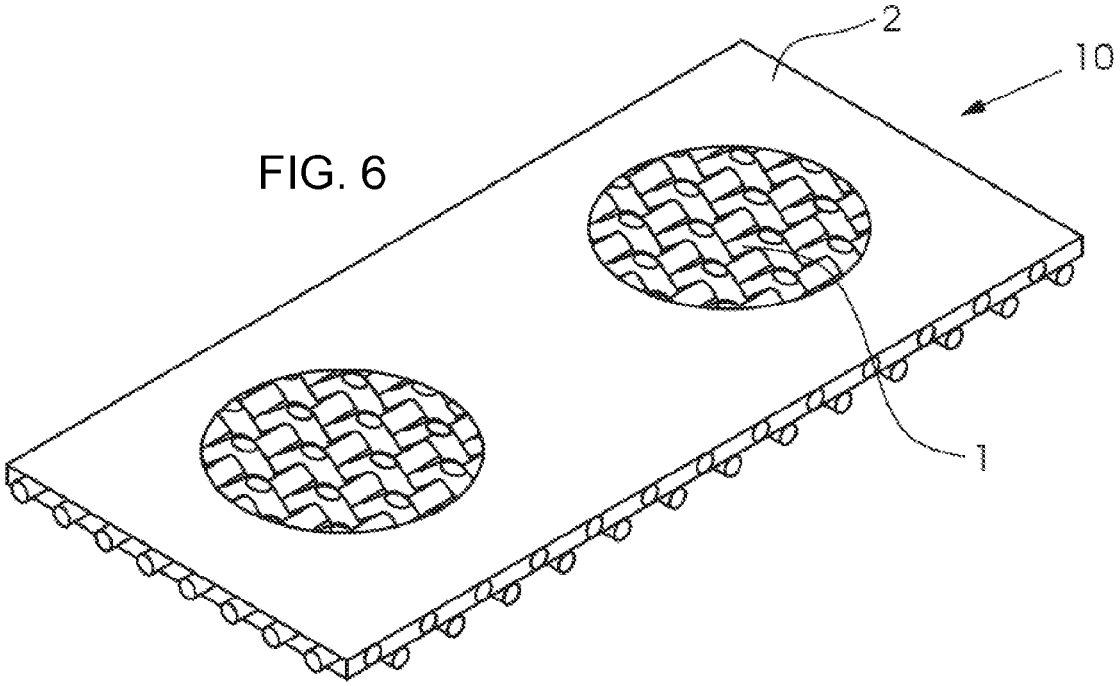
FIG. 6 is a perspective view of a printing screen.

Referring now in detail to the figures of the drawings, in which mutually corresponding elements and components have the same reference symbol and in which the figures are not drawn to scale, and first, particularly, to FIG. 6 thereof, there is seen a flat screen material 10 having a fabric layer 1 in accordance with the prior art. On one side, the screen material 10 has a photopolymer coating 2 (direct stencil). In a non-illustrated alternative embodiment, a film that has already been imaged may be applied to the screen structure 10 (indirect stencil). The nickel-plated flat screen material 10 is built up from the fabric 1. Different forms of fabric, which are also referred to as types of fabric, are possible.

Figure 7:
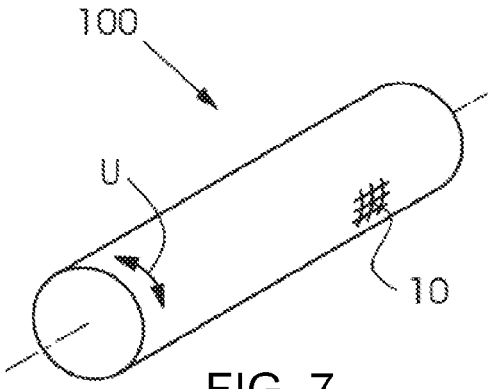
FIG. 7 is a perspective view illustrating the use of the printing screen as a screen in a rotary printing operation.

Screen materials 10 of that kind and printing screens 10 of the invention are used in rotary screen printing. To that end, FIG. 7 indicates a screen 100 including a flat screen material 10 formed to create a cylindrical sleeve for rotary screen printing. The screen material 10 is held in its cylindrical shape by end pieces that are not illustrated in any detail. A non-illustrated squeegee or blade of a screen printing unit is provided in the interior of the screen 100 to press ink through the screen material 10. The squeegee may be oriented to be parallel to the axis of rotation of the screen 100. A double arrow indicates the circumferential direction U of the screen 100 in which the screen rotates during a printing operation.

Figure 1:
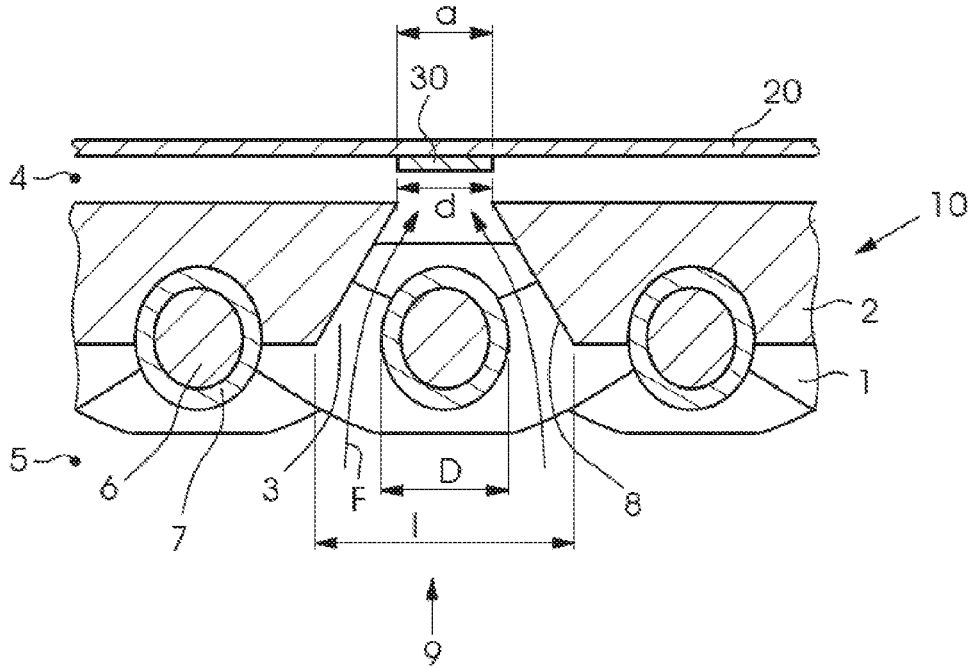
FIG. 1 is a fragmentary, diagrammatic cross-sectional view of a printing screen of the invention.

FIG. 1 is a cross-sectional view of a portion of a printing screen 10 of the invention. The printing screen 10 is formed of a fabric layer 1, which is at least partly embedded in a stencil layer 2. The fabric layer 1 is calendered. Alternatively, non-calendered or more strongly calendered fabric layers 1 may be used in accordance with the invention. The stencil layer 2 may be a photopolymer layer. The fabric layer 1 is formed of a plurality of interwoven fabric threads 6. FIG. 1 illustrates three fabric threads 6 in a cross-sectional view as well as two fabric threads 6 running at right angles relative thereto.

The printing screen 10 has a printing material side 4 and a squeegee side 5. The squeegee side 5 is the side of the ink supply, which is applied to the squeegee side 5 of the printing screen 10 by using a non-illustrated squeegee. Passages 3, which form ink channels, allow ink 30 to travel to the printing material side 4 of the printing screen 10, where the ink comes into contact with a printing material 20. In order to be able to print ink 30 onto a printing material 20 at high quality, a smooth flow F of ink through the passages 3 of the printing screen 10 is required. In order to be able to print very fine dots and ink lines 30 onto a printing material 20, i.e. to be able to print lines of a very small line width a, an opening 9 of the printing screen 10 needs to have a small width at the printing material side 4.

For this purpose, the passages 3 of the printing screen 10 are constructed as follows: the opening 9 has a width I on the squeegee side 5 that is greater than the width d of the opening 9 on the printing material side 4, i.e. $d<I$. The width I of the squeegee side opening 9 is also greater than the diameter D of a coated fabric thread 6 having a metal coating 7. In contrast, the width d of the printing material side opening is smaller than the diameter D of a coated fabric thread, i.e. $I>D>d$. This construction ensures a smooth, reliable, and continuous flow of ink 30 between passage walls 8 flowing past the fabric thread 6 from the squeegee side 5 to the printing material side 4.

Figure 2:
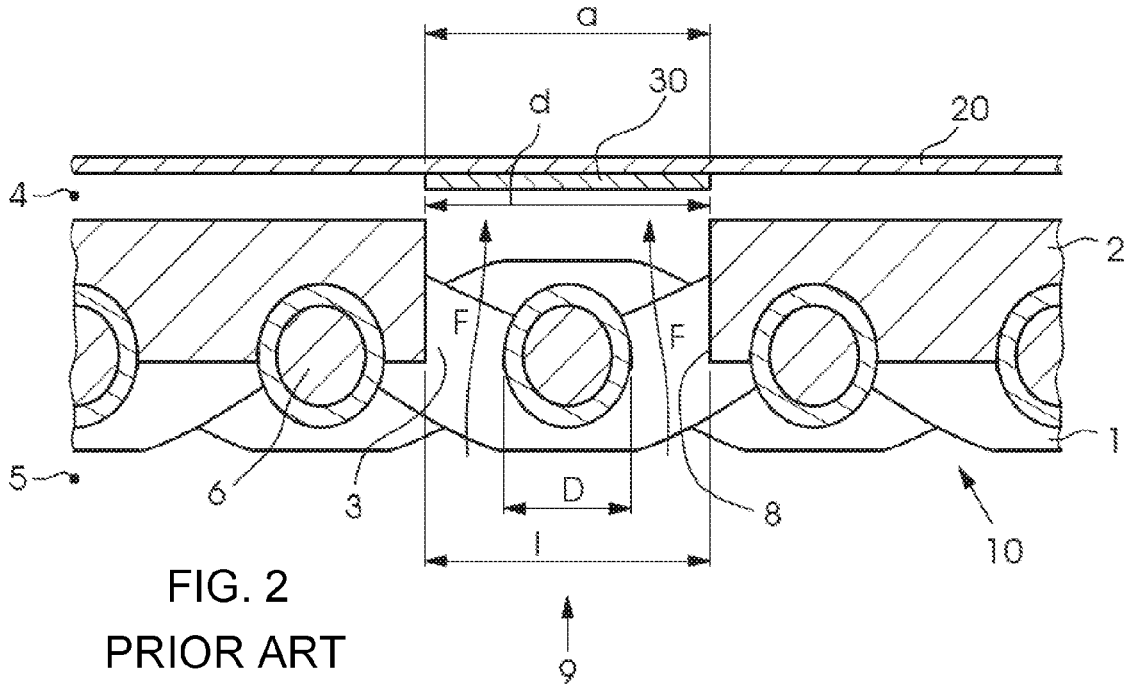
FIG. 2 PRIOR ART
FIG. 2 is a fragmentary, diagrammatic cross-sectional view of a prior art printing screen.

In order to point out the differences between a printing screen 10 of the invention as shown in FIG. 1 and a printing screen of the prior art, FIG. 2 illustrates a printing screen 10 in accordance with the prior art. In such known printing screens, the ink channels are rather wide passages 3 having a constant width over their entire length. Although these passages ensure a smooth flow of ink F, the line width a that can be printed is limited, only allowing comparatively wide ink lines 30 to be printed onto a printing material 20. The printable line width a is a function of the printing material side width d of the opening 9 of the passage 3, which approximately corresponds to the width I of the squeegee side opening 9, i.e. $d \approx I$. The width I of the squeegee side opening 9 is a multiple of the diameter D of a coated thread of fabric, i.e. $I>>D$.

Figure 3A:
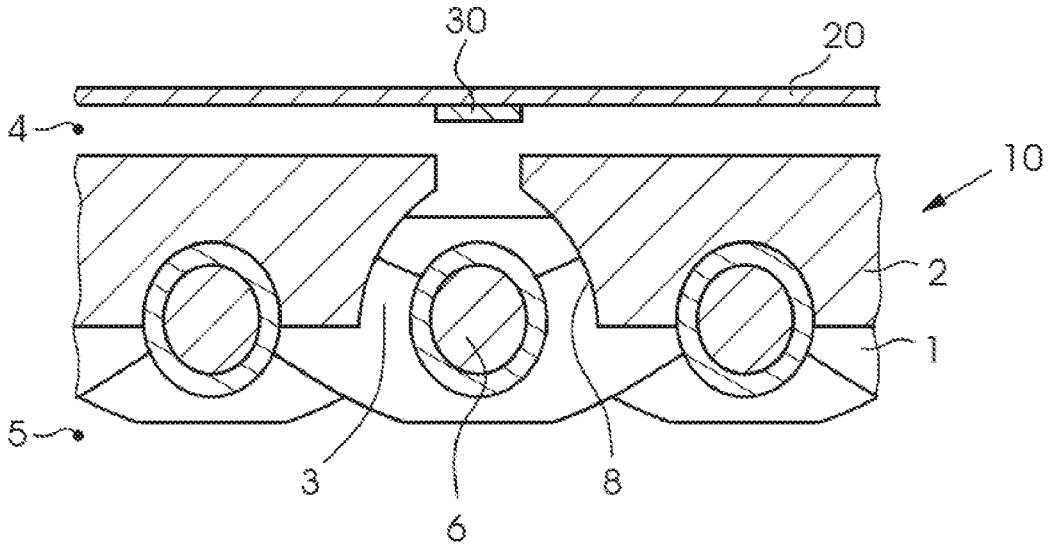
FIGS. 3A-3F are fragmentary, diagrammatic cross-sectional views of different embodiments of the printing screen of the invention.
Figure 3B:
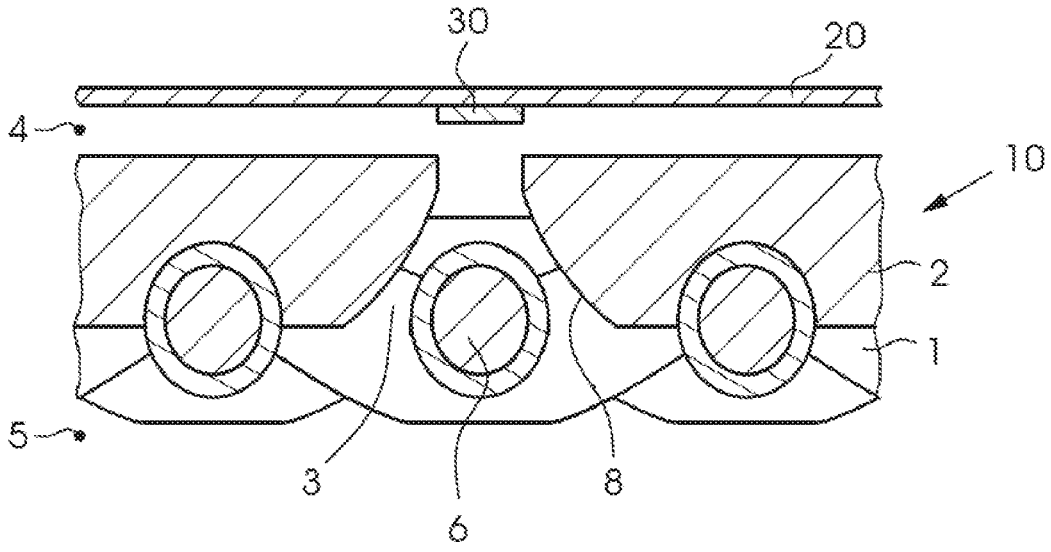
Figure 3C:
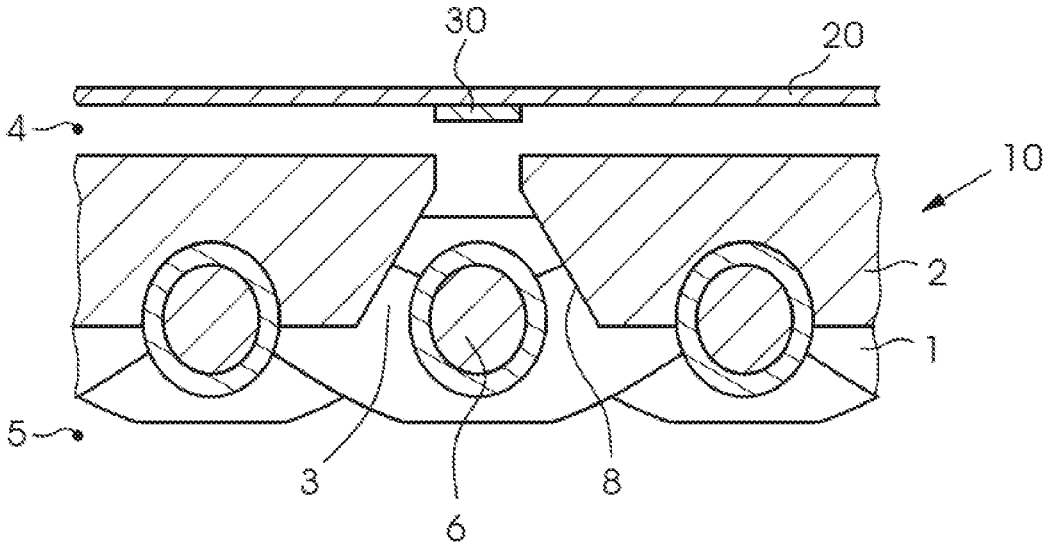
Figure 3D:
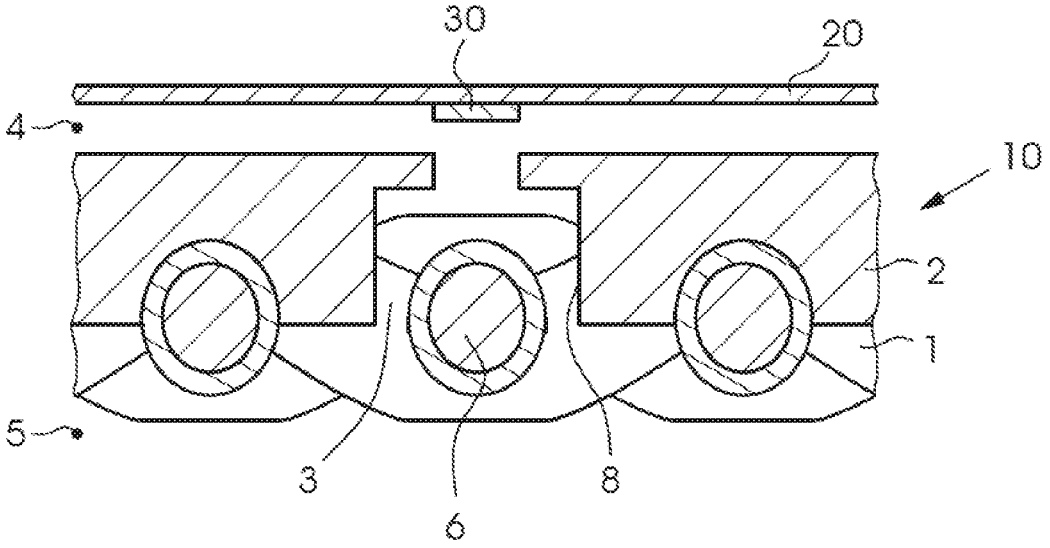
Figure 3E:
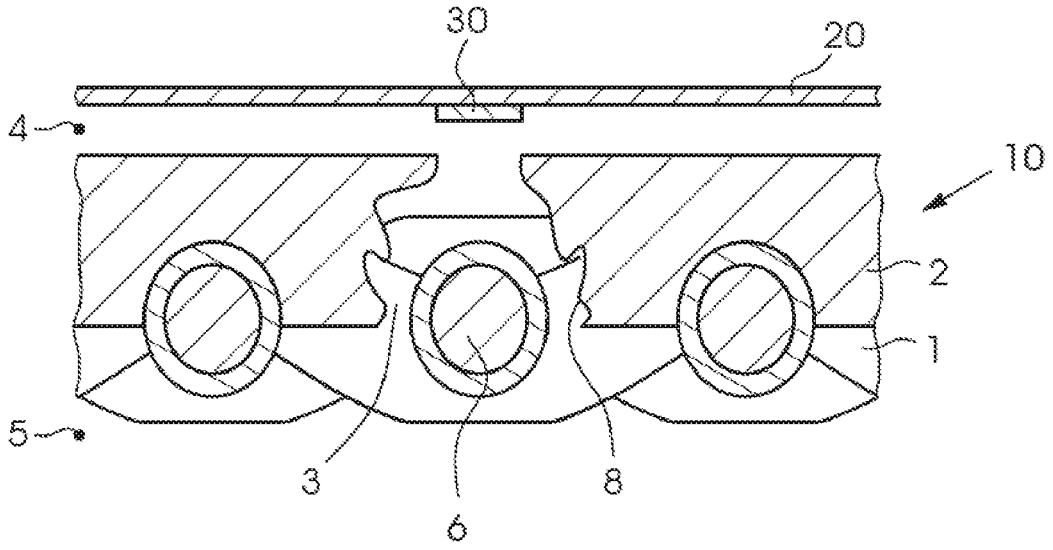
Figure 3F:
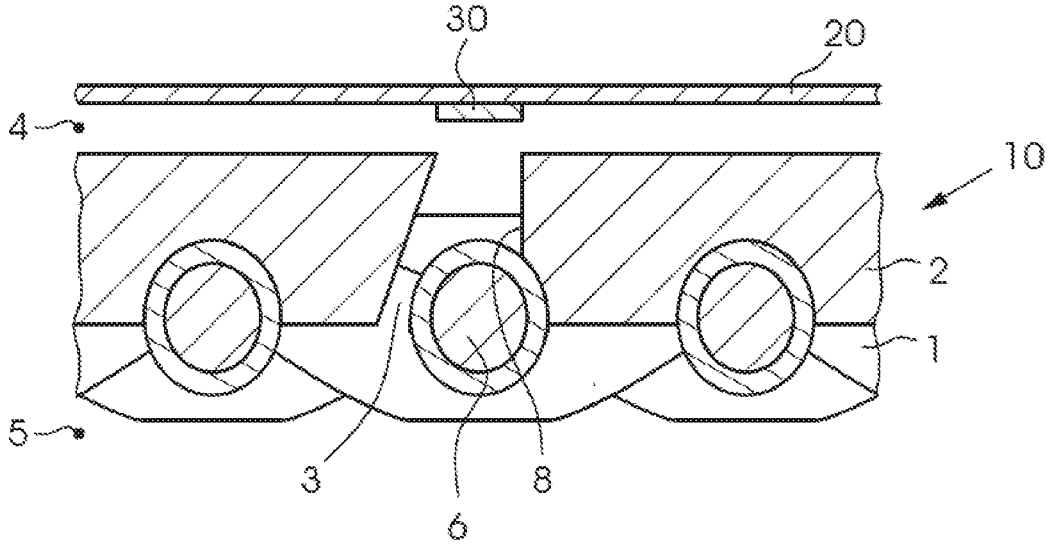

In the exemplary embodiment of the printing screen 10 shown in FIG. 1, the channel walls 8 of the passage 3 have an angled orientation. FIGS. 3A to 3F illustrate alternative geometric shapes of the channel walls 8, which are likewise considered to be advantageous. For instance, in the embodiment of FIG. 3A the channel walls 8 have a concave shape. In the embodiment shown in FIG. 3B, the channel walls have a convex shape. In the embodiment shown in FIG. 3C, similar to the embodiment of FIG. 1, the channel walls 8 are substantially angled, but, in the printing material side end region of the passage 3, they are shaped to be perpendicular to the surface of the printing screen 10. In the embodiment of FIG. 3D, the channel walls 8 have a stepped/step-shaped geometry. The channel walls 8 may have more than the one step shown in FIG. 3. As shown in FIG. 3E, the channel walls may have a free shape, i.e. they may have an arbitrary geometry. As shown in FIG. 3F, a combination of different channel wall constructions for the two channel walls 8 is conceivable. In particular, the geometries shown in FIGS. 1 and 3A to 3E may be combined.

Figure 4:
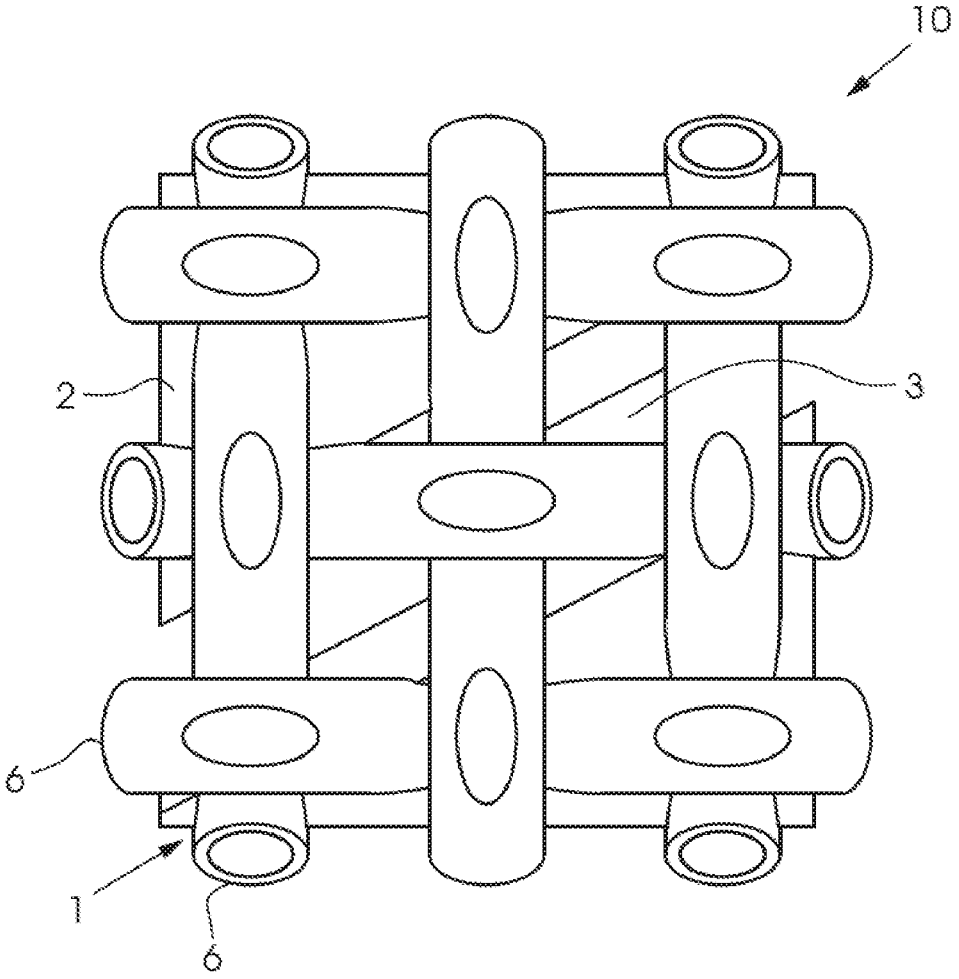
FIG. 4 is a top-plan view of an ink channel.
Figure 5A:
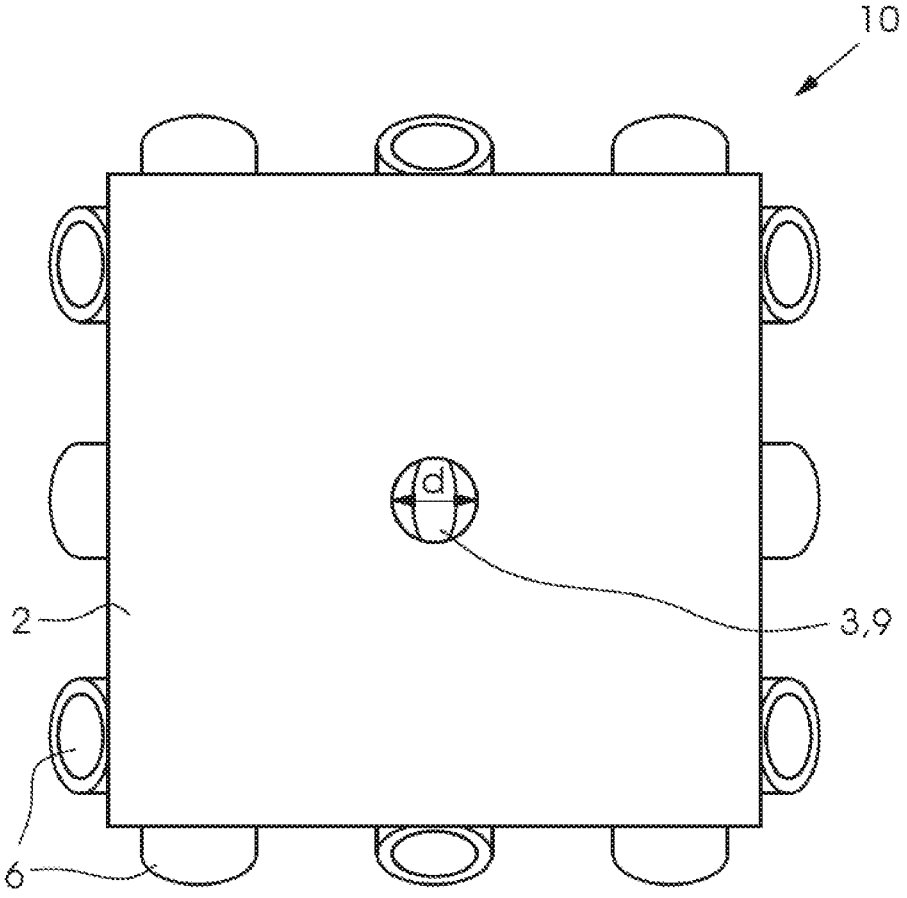
FIGS. 5A and 5B are top-plan views from both sides of a printing screen with a dot-shaped passage.
Figure 5B:
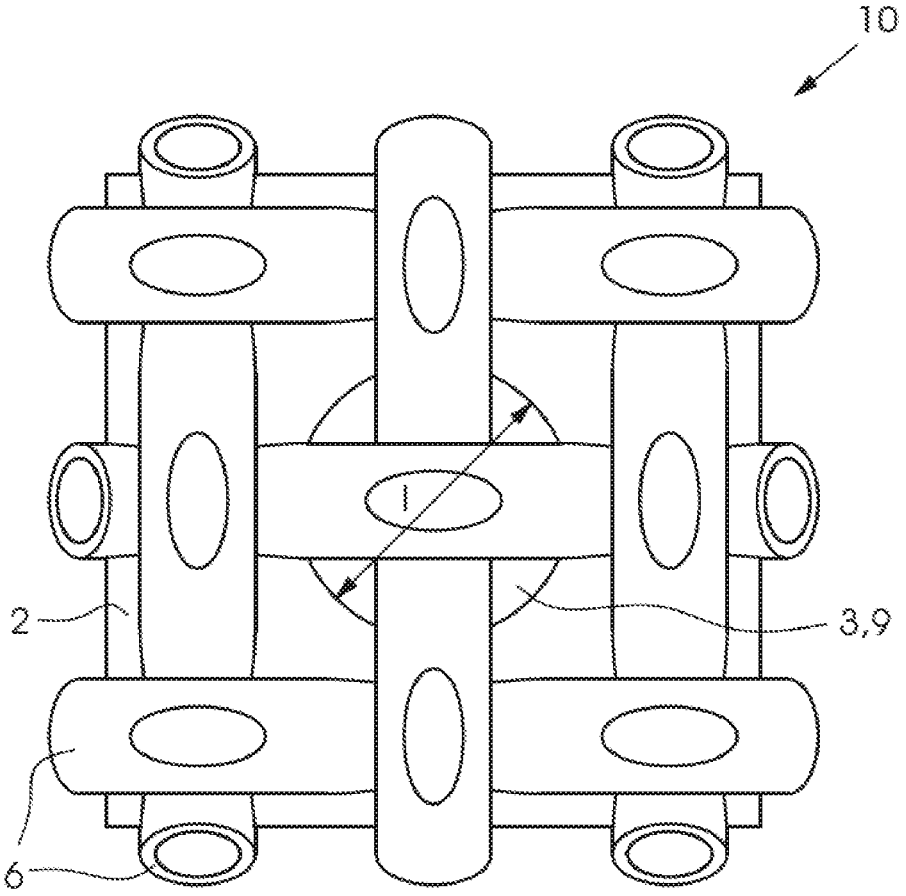

FIG. 4 is a top view of a passage 3 from the squeegee side 5. The passage is embodied as a line-shaped ink channel 3 for printing a line. In contrast, FIGS. 5A and 5B are top views of a printing screen 10 with a dot-shaped passage 3 viewed from both sides of the printing screen, i.e. from the printing material side 4 in FIG. 5A and from the squeegee side 5 in FIG. 5B. Due to the dot-shaped passages 3 having a printing material side diameter d, fine dots of a diameter a may be printed.

The invention claimed is:

1. A printing screen, comprising:

a printing material side and a squeegee side of the printing screen;

a screen-shaped fabric layer acting as a carrier structure, said screen-shaped fabric layer including fabric threads each having a fabric thread diameter; and an imaged stencil layer connected to said fabric layer and provided with passages, each respective passage forming a continuous channel and having an opening on said printing material side and an opening on said squeegee side;

said opening on said printing material side being smaller than said opening on said squeegee side;

said opening on said squeegee side having a width being greater than said fabric thread diameter; and said opening on said printing material side having a width being at most equal to said fabric thread diameter.

2. The printing screen according to claim 1, wherein said fabric threads are disposed at an angle relative to one another.

3. The printing screen according to claim 1, wherein each respective passage forms a line-shaped or dot-shaped ink channel.

4. The printing screen according to claim 1, wherein each respective passage has at least one channel wall with at least one of an angled or stepped or convex or concave shape.

5. The printing screen according to claim 1, wherein said fabric layer is a steel fabric layer.

6. The printing screen according to claim 1, wherein said fabric layer is a stainless steel fabric layer.

7. The printing screen according to claim 1, wherein said fabric layer is provided with a metal coating.

8. The printing screen according to claim 1, wherein said fabric layer is provided with a metal coating containing nickel.

9. The printing screen according to claim 1, wherein said stencil layer is formed of a polymer.

10. The printing screen according to claim 1, wherein said stencil layer is formed of a photopolymer.

* * * * *